United States Patent [19]

Fuchs

[11] Patent Number: 4,655,356

[45] Date of Patent: Apr. 7, 1987

[54] TAMPER INDICATING PACKAGE

[75] Inventor: Timothy J. Fuchs, Toledo, Ohio

[73] Assignee: Owens-Illinois, Inc., Toledo, Ohio

[21] Appl. No.: 845,163

[22] Filed: Mar. 27, 1986

[51] Int. Cl.[4] ..... B65D 41/34

[52] U.S. Cl. ..... 215/230

[58] Field of Search ..... 215/230, 252

[56] References Cited

U.S. PATENT DOCUMENTS

| | | | |
|---|---|---|---|
| 958,887 | 5/1910 | Parmele | 215/252 |
| 3,335,889 | 8/1967 | Brumme | 215/252 |
| 3,930,588 | 1/1976 | Coursaut | 215/252 X |
| 4,225,050 | 9/1980 | Reinhart | 215/252 |
| 4,299,328 | 11/1981 | Ochs et al. | 215/252 |
| 4,572,387 | 2/1986 | Luker et al. | 215/252 |

*Primary Examiner*—Donald F. Norton

*Attorney, Agent, or Firm*—John R. Nelson

[57] ABSTRACT

A tamper indicating package comprising a container having a neck with an external thread and a closure comprising a base wall and a peripheral skirt having an internal thread engaging the thread on the container. The closure includes a tamper indicating band connected to the free edge of the skirt along a weakened line and having an internal bead adapted to engage an annular rib on the neck of the container below the threads. The tamper indicating band includes indicia which is contrasting to any indicia on the closure such that when the closure is removed from the container and reapplied to the container, the absence of the indicia on the bottom of the closure will indicate that the tamper indicating band has been severed from its attached relationship to the closure.

2 Claims, 4 Drawing Figures

TAMPER INDICATING PACKAGE

This invention relates to tamper indicating packages.

BACKGROUND AND SUMMARY OF THE INVENTION

In the packaging of materials, it has been common to provide a tamper indicating package which comprises a tamper indicating package comprising a container having a neck with an external thread and a closure comprising a base wall and a peripheral skirt having an internal thread engaging the thread on the container. The closure indicates an tamper indicating band connected to the free edge of the skirt along a weakened line and having an internal bead adapted to engage an annular rib on the neck of the container below the threads.

One of the problems with such construction is that when the closure is removed and the tamper indicating band severed from the closure, the reapplication of the closure sometimes produces a visual appearance that cannot be readily distinguished from the package when the closure and tamper indicating band are intact.

In U.S. application Ser. No. 824,808, filed Jan. 31, 1986, having a common assignee in the present application, there is disclosed a tamper indicating closure which relies on color coding the tamper indicating band either by using a different colored plastic or by adding a color as by inking to the band after fabrication. Making a closure of two differently colored plastics is difficult. Adding a color after fabrication requires additional manufacturing steps.

Accordingly, among the objectives of the present invention are to provide a tamper indicating package with a closure which is so constructed and arranged that the user can readily easily distinguish by sight the presence of a tamper indicating band on or off the closure.

In accordance with the invention, the tamper indicating band includes indicia which is contrasting to any indicia on the closure such that when the closure is removed from the container and reapplied to the container, the absence of the indicia on the bottom of the closure will indicate that the tamper indicating band has been severed from its attached relationship to the closure.

DESCRIPTION

Figure 1:
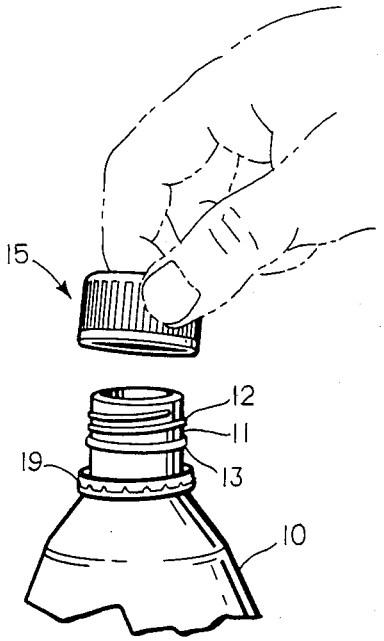
FIG. 1 is a fragmentary exploded view of a tamper indicating package embodying the invention.

Referring to FIG. 1, the tamper indicating package embodying the invention comprises a container 10 having a neck 11 with an external thread 12 and an annular rib 13 spaced axially below the thread. The package further comprises a closure 15 having a base wall 16 and a peripheral skirt 17 with internal threads 18 adapted to engage the threads 12 on the container 10. A tamper indicating band 19 is connected to the lower edge of the skirt 17 by a weakened line such as bridge portions 20. The tamper indicating band 19 further includes an integral inwardly extending annular bead 21 that engages below the rib 13 such that when the closure is unthreaded, the tamper indicating band 19 is severed along the weakened line 20 to indicate to a user that the contents have been tampered with.

The closure is made of plastic preferably polyprolylene. The container may be made of glass or plastic.

Figure 2:
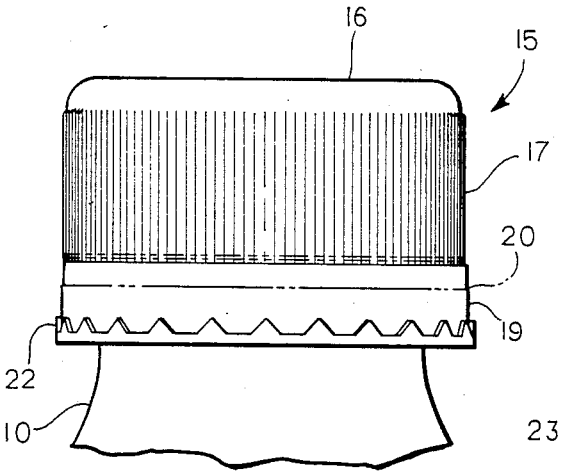
FIG. 2 is a fragmentary elevational view of the package.
Figure 4:
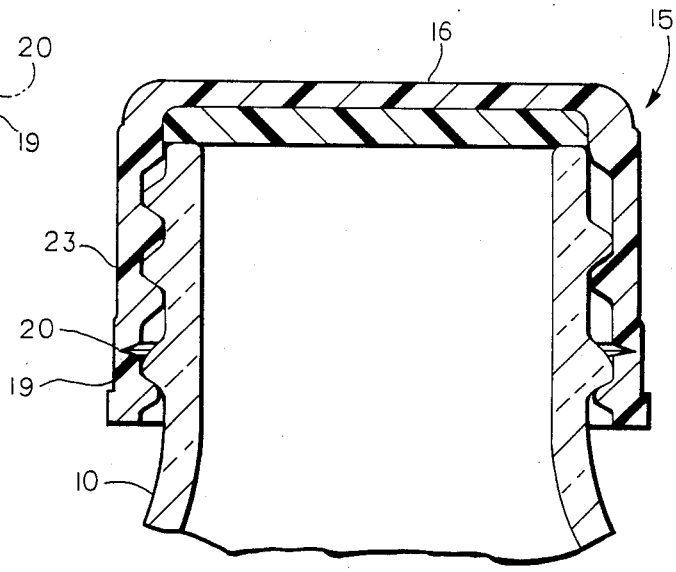
FIG. 4 is a vertical sectional view through the package.

In accordance with the invention as shown in FIG. 2, the tamper indicating band 19 is provided with distinctive indicia 22 about the periphery thereof which is readily distinguishable from any markings such as knurling or vertical ribs 23 the like on the skirt. More specifically the indicia 22 comprises a row of raised triangular projections.

Figure 3:
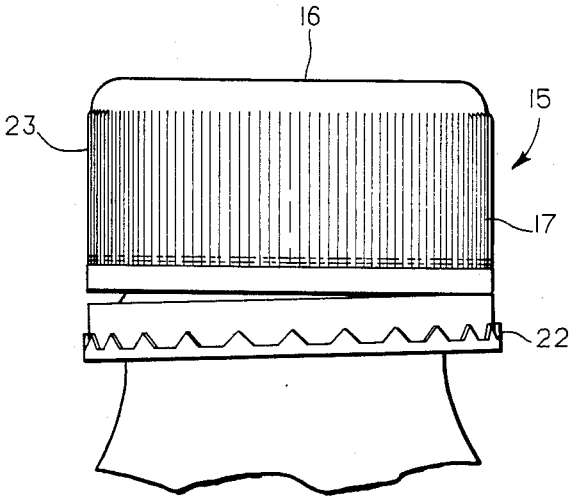
FIG. 3 is a view similar to FIG. 2 showing the tamper indicating band partially severed.

As a result, when the closure is removed severing the tampering band from the skirt, the fact that the band has been broken or severed from the closure is readily distinguished by the user (FIG. 3).

I claim:

1. A tamper indicating package comprising a container having a neck with an external thread and annular rib, a closure comprising a base wall and a peripheral skirt having an internal thread engaging the thread on the container, said closure including a tamper indicating band connected to the free edge of the skirt along a weakened line and having an internal bead adapted to engage said annular rib on the neck of the container below the threads, said tamper indicating band including raised indicia on the outer surface of the band about the entire periphery of said band which is contrasting to any indicia on the closure such that when the closure is removed from the container and reapplied to the container, the absence of the tamper indicating band will be highly visible and distinguishable indicating that the tamper indicating band has been severed from its attached relationship to the closure.

2. A tamper indicating closure for use with a container having a neck with an external thread and an annular rib, said closure comprising a base wall and a peripheral skirt having an internal thread engaging the thread on the container, said closure including a tamper indicating band connected to the free edge of the skirt along a weakened line and having an internal bead adapted to engage an annular rib on the neck of the container below the threads, said tamper indicating band including raised indicia on the outer surface of the band about the entire periphery of said band which is contrasting to any indicia on the closure such that when the closure is removed from the container and reapplied to the container, the absence of the tamper indicating band will be highly visible and distinguishable indicating that the tamper indicating band has been severed from its attached relationship to the closure.

* * * * *